United States Patent [19]

Hansen

[11] 4,211,442

[45] Jul. 8, 1980

[54] LOCK STRIKE

[76] Inventor: John D. Hansen, 2136 Grahn, Santa Rosa, Calif. 95404

[21] Appl. No.: 2,074

[22] Filed: Jan. 8, 1979

[51] Int. Cl.[2] ..... E05C 13/00

[52] U.S. Cl. ..... 292/340

[58] Field of Search ..... 292/145, 251, 340, 341.18, 292/346, DIG. 15; 85/41, 43

[56] References Cited

U.S. PATENT DOCUMENTS

| | | | |
|---|---|---|---|
| 1,571,574 | 2/1926 | Crossley | 292/251 X |
| 2,746,782 | 5/1956 | Schamotta | 292/251 |
| 3,107,934 | 10/1963 | Lee | 292/340 X |
| 4,065,162 | 12/1977 | Schloge | 292/340 |

FOREIGN PATENT DOCUMENTS

| | | | |
|---|---|---|---|
| 15011 | of 1905 | United Kingdom | 292/340 |
| 722029 | 1/1955 | United Kingdom | 292/251 |

*Primary Examiner*—Richard E. Moore

*Attorney, Agent, or Firm*—Flehr, Hohbach, Test, Albritton & Herbert

[57] ABSTRACT

Strike for receiving the bolt of a lock or similar device. The strike is securely anchored to a substantial structural member and provides greater security than is possible with conventional jamb-mounted strike plates and strike boxes.

5 Claims, 3 Drawing Figures

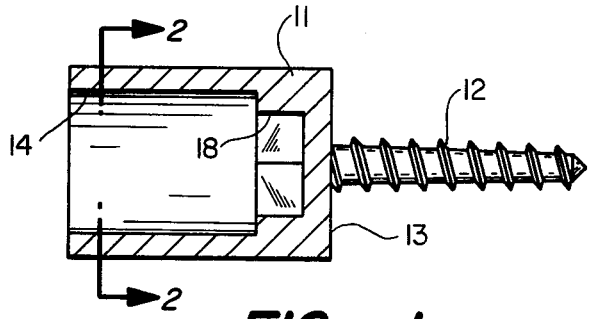
FIG__1
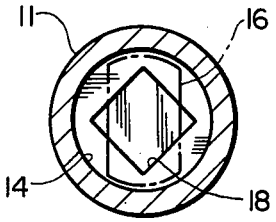
FIG__2
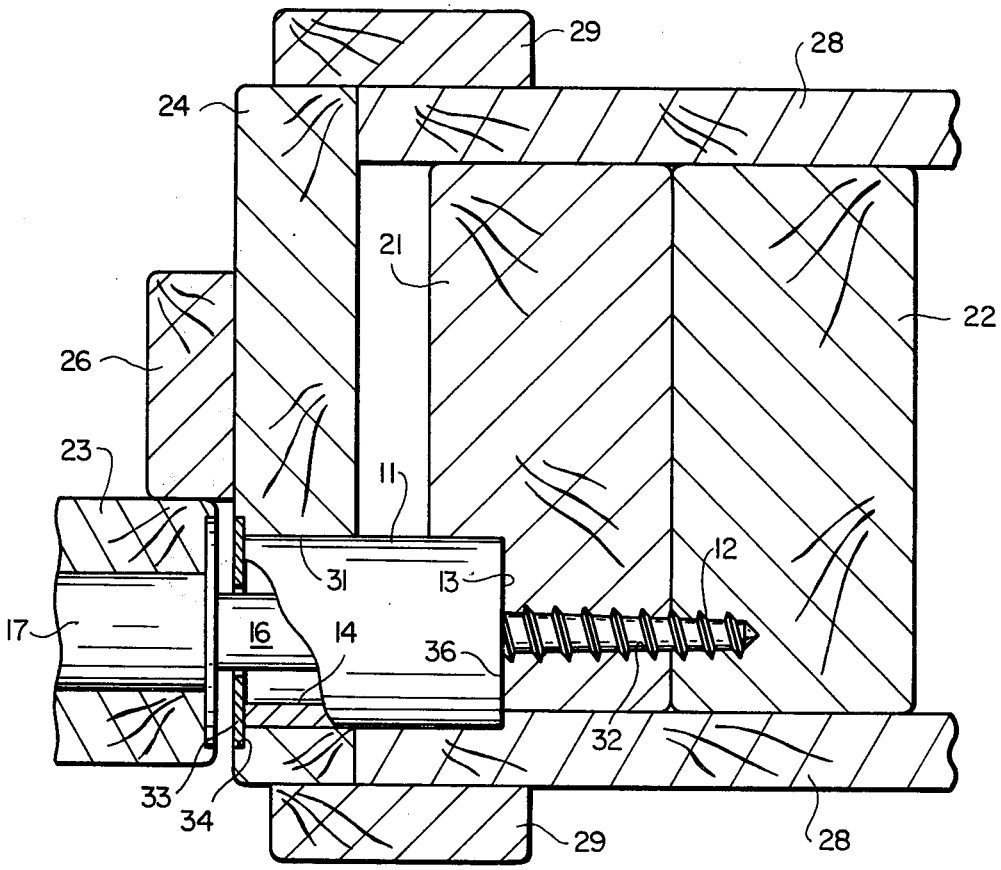
FIG__3

LOCK STRIKE

This invention pertains generally to locks and security devices and more particularly to a strike for receiving the latchbolt or deadbolt of a lock.

In recent years, a number of locks, including deadbolt locks, have been made with longer and heavier bolts than conventional locks in order to provide increased security. However, the security actually realized with such locks has been limited because the lock bolt is commonly received in a strike plate or strike box mounted on or in a relatively weak wooden doorjamb which can be broken apart by a moderate blow to the door.

It is in general an object of the invention to provide a new and improved lock strike which will provide greater security than do the strike plates and strike boxes of the prior art.

Another object of the invention is to provide a lock strike of the above character which can be anchored to a structural member behind the doorjamb.

Another object of the invention is to provide a lock strike of the above character which can be utilized with existing locks and in existing structures.

These and other objects of the invention are achieved by providing a lock strike having an elongated body adapted to extend through the doorjamb to a structural member behind the jamb, with a mounting screw extending from the inner end of the body into the structural member for anchoring the device securely to that member. A socket is formed in the outer end of the body for receiving the lock bolt, and a drive socket is provided for receiving a tool for driving the screw into the structural member.

FIG. 1 is a centerline sectional view of one embodiment of a lock strike according to the invention.

FIG. 2 is a cross-sectional view taken along line 2—2 in FIG. 1.

FIG. 3 is a horizontal sectional view, fragmentary and partly broken away, showing the installation of the lock strike of FIG. 1 in a conventional doorframe.

As illustrated in the drawings, the lock strike comprises an elongated generally cylindrical body 11 adapted to be mounted in the frame around a door. As discussed more fully hereinafter, the body is of sufficient length to extend through the doorjamb and into the trimmer or other structural member behind the jamb. A mounting screw 12 extends axially from one end of the body for anchoring the strike to the structural member, and adjacent to the base of the screw, the body has an axially facing shoulder which bears against a corresponding surface of the structural member. A socket 14 is formed in the body toward the other end of the same for receiving the projecting bolt 16 of a lock 17. In the embodiment illustrated, this socket comprises an axially extending blind bore of suitable diameter and depth for receiving the bolt in locking or mating relationship. With a generally rectangular bolt having a height of $\frac{7}{8}$ inch, width of $\frac{1}{2}$ inch and a length of 1 inch, for example, the socket can have a diameter of 15/16 inch and a depth of $1\frac{1}{4}$ inch.

A drive socket 18 is formed in the body at the inner end of the lock bolt socket for receiving a rotative driving tool whereby the strike can be rotated to drive the mounting screw. As illustrated, this socket is generally square in cross section and is adapted to receive the tip of an extension bar of the type commonly employed with socket wrenches.

In the preferred embodiment, the body and screw are formed as a unitary structure of a rigid material such as mild steel which is blued or otherwise treated to prevent the formation of rust. Alternatively, a separate lag screw extending through the inner wall of the strike body can be employed instead of the integral screw, in which case the head of the screw would be accessible through socket 14. Similarly, the body can extend the full length of the strike, with the inner end portion of the body being tapered and threaded to form a screw having roughly the same ultimate diameter as the remainder of the body.

FIG. 3 shows the lock strike installed in a typical wood frame building having upright structural members, commonly known as a trimmer 21 and a stud 22, on each side of the opening for a door 23. The door is mounted by hinges (not shown) in a frame comprising a jamb 24 and a doorstop 26 which extend along the side and top edges of the door. The doorstop is affixed to the jamb and serves as a limiting abutment for the door when the door is closed. The door opening is generally made somewhat larger than the doorframe to permit accurate alignment of the door within the rough framing. Consequently, the jamb is typically spaced from the trimmer by a distance which varies from zero to about $\frac{3}{4}$ inch, and wedges or shims (not shown) are utilized between the jamb and trimmer to permit proper alignment of the door. Wall facing 28 is provided on opposite sides of the trimmer and stud, and molding 29 extends along the sides and top of the door opening to provide a finished appearance. Lock 17 is mounted in door 23, with bolt 16 projecting from one side edge of the door in its extended position.

The strike is installed by drilling a hole 31 through the doorjamb and into the trimmer in axial alignment with the lock bolt. A hole 32 of smaller diameter continues through the trimmer and into the stud for receiving the mounting screw of the strike. Hole 31 is drilled to a depth somewhat greater than the length of the strike body so that the strike can be recessed behind a strike plate 33 which is mounted in a mortise 34 in the outer surface of the doorjamb. If desired, holes 31 and 32 can be drilled in a single operation by means of a special spade bit made for the purpose.

Once the holes have been drilled, the strike is inserted and rotated as a unit to drive the screw into the trimmer and stud until shoulder 13 abuts tightly against the inner or bottom wall 36 of hole 31. Strike plate 33 is then installed over the outer end of the strike and secured by mounting screws (not shown).

The invention has a number of important features and advantages. Being securely anchored to substantial structural members, the strike is substantially stronger than a conventional strike plate or strike box attached only to a relatively weak doorjamb. The strike is easy to install and can be utilized with existing locks and existing frame structures.

It is apparent from the foregoing that a new and improved lock strike has been provided. While only one presently preferred embodiment has been described, as will be apparent to those familiar with the art, certain changes and modifications can be made without departing from the scope of the invention as defined by the following claims.

What is claimed is:

1. In a lock strike for use with a door mounted in a frame having a door jamb spaced from the structural member of a wall and a lock having a retractable bolt extending from one edge of the door: an elongated body extending through the jamb and into the structural member behind the jamb, said body having an axially facing shoulder toward the inner end thereof in abutting engagement with the structural member, a screw extending axially from the shoulder into the structural member to anchor the body to the structural member, and a socket formed in the body toward the outer end thereof in position to receive the lock bolt when said bolt is in an extended position.

2. The lock strike of claim 1 wherein the screw and body are formed as a unitary structure.

3. The lock strike of claim 1 further including a drive socket formed in the body for receiving a tool for driving the screw into the structural member.

4. In a lock strike construction: a door mounted in a frame having a jamb spaced from a structural member of a wall, a lock mounted on the door with a retractable bolt extending from one edge thereof an elongated body extending through the jamb and into the structural member behind the jamb, said body having an axially facing shoulder toward the inner end thereof in abutting engagement with the structural member, a screw formed integrally with the body extending axially from the shoulder into the structural member to anchor the body to the structural member, and a socket formed in the body toward the outer end thereof in position to receive the lock bolt when said bolt is in an extended position.

5. The lock construction strike of claim 4 further including a drive socket formed in the body for receiving a tool for driving the screw into the structural member.

* * * * *